United States Patent [19]

Dittrich et al.

[11] Patent Number: 4,464,905

[45] Date of Patent: Aug. 14, 1984

[54] CRYOSORPTION PUMP

[75] Inventors: Hans Dittrich, Karlsruhe; Hartmut Frey, Esslingen; Ralf-Dieter Penzhorn, Bruchsal, all of Fed. Rep. of Germany

[73] Assignee: Kernforschungszentrum Karlsruhe GmbH, Karlsruhe, Fed. Rep. of Germany

[21] Appl. No.: 507,669

[22] Filed: Jun. 24, 1983

[30] Foreign Application Priority Data

Jul. 17, 1982 [DE] Fed. Rep. of Germany ..... 3226785

[51] Int. Cl.[3] ..... B01D 8/00

[52] U.S. Cl. ..... 62/55.5; 62/268; 55/269; 417/901

[58] Field of Search ..... 62/55.5, 100, 268; 55/269; 417/901

[56] References Cited

U.S. PATENT DOCUMENTS

| | | | |
|---|---|---|---|
| 1,307,999 | 6/1919 | Buckley | 62/55.5 |
| 2,879,157 | 3/1959 | Batutis et al. | 62/55.5 |
| 3,382,585 | 5/1968 | Blake et al. | 62/55.5 |

FOREIGN PATENT DOCUMENTS

| | | | |
|---|---|---|---|
| 493561 | 2/1976 | U.S.S.R. | 62/55.5 |

OTHER PUBLICATIONS

Lexikon Technik und exakte Naturwissenschaften, published by Fischer Taschenbuch, vol. 10, 1972, pp. 2990–2993.

Chemie Ingenieur Technik, published by Verlag Chemie GmbH, vol. 40, 1968, Issue 5, pp. 207, 213.

*Primary Examiner*—Ronald C. Capossela

*Attorney, Agent, or Firm*—Spencer & Frank

[57] ABSTRACT

A cryosorption pump comprises a pump housing; a supply conduit merging into the pump housing for introducing sorption material thereinto; an outlet conduit opening into the pump housing at a location below and spaced from the supply conduit; a plurality of heat conducting wall surfaces disposed in the pump housing; a refrigerator operatively connected to the wall surfaces for cooling them to a cryogenic temperature to which the sorption material situated between the wall surfaces is exposed; a regenerator connected to the outlet and supply conduits for regenerating sorbent-laden sorption material received from the pump housing by means of the outlet conduit and for admitting sorbent-free sorption material into the supply conduit; a first conveyor arranged in the outlet conduit for advancing sorbent-laden sorption material from the pump housing into the regenerator; and a second conveyor arranged in the supply conduit for advancing sorbent-free sorption material from the regenerator into the pump housing.

10 Claims, 1 Drawing Figure

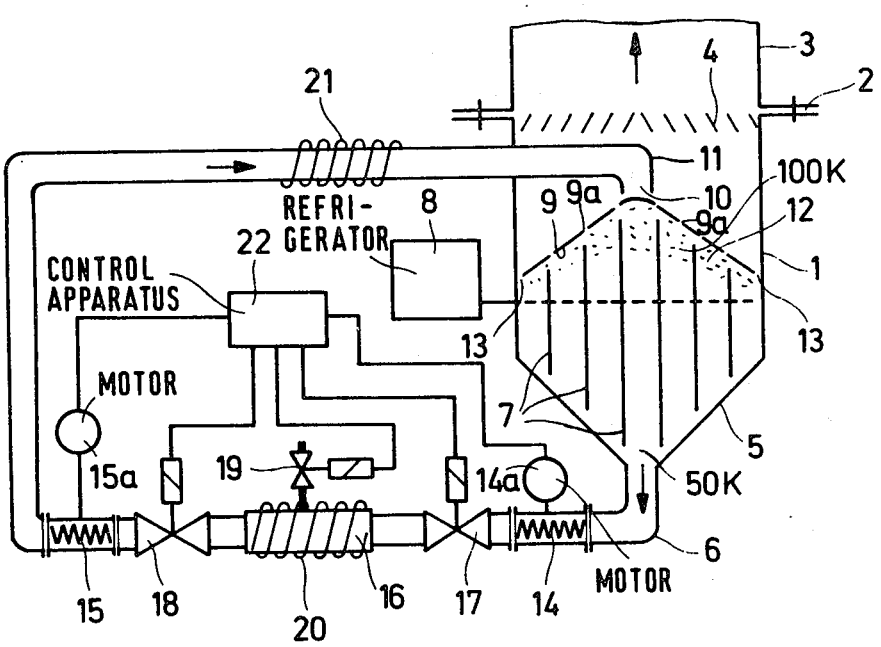
21
REFRI-
GERATOR
22
8
CONTROL
APPARATUS
MOTOR
15a
19
14a
15
18
20
16
17
14
MOTOR
6
50K
5
7
13
9
9a
10
11
100K
12
1
2
3
4

CRYOSORPTION PUMP

BACKGROUND OF THE INVENTION

This invention relates to a single-stage, sorption-type cryopump (hereafter cryosorption pump) for a pressure range of between 1,000 millibar and $10^{-7}$ millibar and includes a refrigerator connected in a heat transmitting manner with metallic wall surfaces. Further, at the wall surfaces a sorption material is disposed whose temperature—which, during a predetermined desorption period raises approximately to room temperature—is set by means of the refrigerator to approximately 60 K. during the sorption period.

The known cryopumps include metallic wall surfaces which are arranged in a pump vessel and which are cooled by a refrigerator coupled to the pump vessel, for example, in two stages, first to approximately 70 K. and then to 20 K. so that on the wall surfaces the gases and vapors condense and form a solid deposit as described, for example, on page 2993, Volume 10 of the work entitled Lexikon Technik und exakte Naturwissenschaften (Encyclopaedia of Engineering and Exact Natural Sciences), published by Fischer Taschenbuch Verlag, 1972. The known cryopump, however, requires a pre-vacuum of approximately $10^{-3}$ millibar because a cooling at atmospheric pressure would lead to an excessively thick condensate layer which, in turn, would adversely affect the operation of the pump at low pressures. The auxiliary pump which generates the pre-vacuum is an electromechanical pump which necessarily contaminates the vacuum with oil.

In certain applications, it is required to maintain the vacuum rigorously free from oil particles. Thus, in the manufacture of electronic structures in high vacuum, because of the microscopically thin layers which have to be built, the appearance of hydrocarbon molecules causes an approximately 70% waste which significantly increases the manufacturing expenses. Also, similar requirements for an oil-free vacuum apply in the field of fusion technology.

There are known sorption pumps in which gases are absorbed by a sorption material, such as activated carbon. The sorption material is, however, after a predetermined period, saturated with the absorbed gas and consequently the pumping operation has to be suspended in order to regenerate the sorption material. As a result, a high vacuum can be maintained for a longer period only with significant expense, if at all.

As discussed, for example, in the periodical Chemie Ingenieur Technik (Chemical Engineering), Volume 40, 1968, Issue 5, pages 207–213 (published by Verlag Chemie GmbH, Weinheim, Federal Republic of Germany), it is known to combine a cryopump and a sorption pump to form a "cryosorption pump" and to fixedly connect metallic wall surfaces with a molecular sieve. Such an arrangement, however, has the disadvantages of a sorption pump so that the set high vacuum cannnot be maintained during the periods of regenerating the molecular sieve.

SUMMARY OF THE INVENTION

It is an object of the invention to provide an improved cryosorption pump in which the degasification of the sorption material can be preformed without interrupting the pumping operation.

This object and others to become apparent as the specification progresses, are accomplished by the invention, according to which, briefly stated, the cryosorption pump comprises a pump housing; a supply conduit merging into the pump housing for introducing sorption material thereinto; an outlet conduit opening into the pump housing at a location below and spaced from the supply conduit; a plurality of heat conducting wall surfaces disposed in the pump housing; a refrigerator operatively connected to the wall surfaces for cooling them to a cryogenic temperature to which the sorption material situated between the wall surfaces is exposed; a regenerator connected to the outlet and supply conduits for regenerating sorbent-laden sorption material received from the pump housing by means of the outlet conduit and for admitting sorbent-free sorption material into the supply conduit; a first conveyor arranged in the outlet conduit for advancing sorbent-laden sorption material from the pump housing into the regenerator; and a second conveyor arranged in the supply conduit for advancing sorbent-free sorption material from the regenerator into the pump housing.

The advantages of the cryosorption pump according to the invention reside in particular in that independently from the initial pressure prevailing at the beginning of the pumping operation, a predetermined high vacuum may be set and maintained without time limitation and further, the high vacuum is entirely free from oil particles.

BRIEF DESCRIPTION OF THE DRAWING

The sole FIGURE is a schematic view, partially in block diagram form, of a preferred embodiment of the invention.

DESCRIPTION OF THE PREFERRED EMBODIMENT

The upper end of a vertically oriented pump housing 1 is adjoined by a vacuum vessel 3 by means of a flange connection 2. An optical screen 4 positioned in the plane of the flange connection 2 prevents infrared radiation from entering into the pump housing 1.

The pump housing 1 has a bottom 5 which has the shape of a circular cone whose downwardly oriented apex is joined by an outlet conduit 6. In the pump housing 1 there are arranged a plurality of planar wall surfaces 7 formed of copper or aluminum sheets arranged in a vertical, parallel-spaced orientation. The wall surfaces 7 are connected in a heat-conducting manner with a refrigerator 8 which cools the wall surfaces 7 to a cryogenic temperature of approximately 40 K.

Above the wall surfaces 7 in the pump housing 1 there is arranged a conical diverter 9 whose upwardly oriented apex is situated closely underneath a discharge opening 10 of a supply conduit 11. The conicity of the diverter 9 is identical to the inclination of the alluvial cone of granulated sorption material 12 which is admitted by means of the supply conduit 11 and which fills the space between the bottom 5 of the pump housing 1 and the diverter 9 in the zone of the deep-cooled wall surfaces 7.

The length and shape of each deep-cooled wall surface 7 is determined by the alluvial cone of the granulated sorption material 10 and the bottom 5 of the pump housing 1.

Each wall surface 7 is situated from the bottom 5 of the pump housing 1 and the diverter 9 at a predetermined distance which ensures a unhindered passage of the sorption material 12.

The unhindered passage of the granulated sorption material 12 which may be, for example, zeolite, activated carbon or getter material, is furthermore ensured by providing the diverter 9 with a plurality of apertures whose diameter is adapted to the grain cross section of the granulated sorption material. The apertures provide for a uniform distribution of the material in the chambers formed between the wall surfaces 7. The same purpose is served by an annular gap 13 which is formed between the periphery of the diverter 9 and the side wall of the pump chamber 1.

In the outlet conduit 6 there is arranged a first conveyor 14 which removes the sorbent-laden sorption material 12 from the pump housing 1. The first conveyor 14 is a conveyor screw driven by an electric motor 14*a*.

In the supply conduit 11 there is arranged a second conveyor 15 for advancing the sorbent-free granulated sorption material 12 into the pump housing 1. The conveyor 15 may be identical in structure to that of the first conveyor 14 and is driven by an electric motor 15*a*.

The outlet conduit 6 and the supply conduit 11 are connected with one another by means of a regenerator 16 which desorbs the sorption material 12.

The regenerator 16 comprises a tubular container whose end connected with the outlet conduit 6 is provided with an inlet shutoff valve 17 while its end connected with the supply conduit 11 is provided with an outlet shutoff valve 18.

The regenerator 16 has at least one escape valve 19 through which the gases set free from the sorption material 12 during the desorption at temperature increase may pass.

The inlet valve 17, the outlet valve 18 and the escape valve 19 are solenoid valves.

The regenerator 18 may be connected with a heating device 20 which, for accelerating the desorption process, may set the regenerator to a predetermined temperature of, for example, approximately 400 K.

The supply conduit 11 passes through a cooling device 21 which cools the granulated sorption material 12 to a temperature of approximately 100 K. before its entry into the pump housing 1.

An optimal operation of the cryosorption pump is ensured by a control device 22 which, during a settable time period for the desorption of the sorption material 12 present in the regenerator 16, maintains the escape valve 19 open and simultaneously maintains the inlet valve 17 and the outlet valve 18 closed and de-energizes the first and second conveyors 14 and 15.

The granulated sorption material 12 thus continuously fills the space between the deep-cooled wall surfaces 7 as well as the volume of the outlet conduit 6, the regenerator 16 and the supply conduit 11.

The granulated sorption material 12 is cooled by the cooling device 21 to such an extent that it leaves the supply conduit 11 at a temperature of approximately 100 K. In the zone of the deep-cooled wall surfaces 7 the temperature of the sorption material 12 is lowered to approximately 50 K., thereby accelerating the sorption of gases as the temperature drops. Then, the control apparatus 22 opens the inlet valve 17 and the outlet valve 18, closes the escape valve 19 and at the same time, switches on the first and second conveyors 14 and 15 so that the sorption material charged with sorbents in the pump housing 1 is advanced into the rengenerator 16. Simultaneously, the desorbed sorption material 12, dwelling in the regenerator 16 from the previous treatment, is advanced into the supply conduit 11 and, prior to its reintroduction into the pump housing 1, is cooled to approximately 100 K. by the cooling device 21.

Thus, according to the invention, a granulated sorption material may be treated in a cryosorption pump in a closed circuit, while a spatial separation of sorption volume and desorption volume is effected. Consequently, independently from the initial pressure prevailing at the beginning of the pumping operation, a predetermined vacuum down to $10^{-7}$ millibar may be set and maintained without time limitation. The high vacuum is entirely free from oil particles since no electromechanical pre-pump is required.

It will be understood that the above description of the present invention is susceptible to various modifications, changes and adaptations, and the same are intended to be comprehended within the meaning and range of equivalents of the appended claims.

What is claimed is:

1. A cryosorption pump comprising:

(a) a pump housing;

(b) a supply conduit for guiding granulated sorption material therein; said supply conduit having an inlet end and a discharge end; said discharge end merging into said pump housing for introducing sorption material into said pump housing;

(c) an outlet conduit for guiding sorption material therein; said outlet conduit having an inlet end and a discharge end; said inlet end of said outlet conduit opening into said pump housing at a location below and spaced from said discharge opening of said supply conduit;

(d) a plurality of heat conducting wall surfaces disposed in said pump housing in a space between said discharge end of said supply conduit and said inlet end of said outlet conduit; said wall surfaces being spaced from one another for accommodating sorption material therebetween;

(e) a refrigerator operatively connected to said wall surfaces for cooling said wall surfaces to a cryogenic temperature to which the sorption material situated between said wall surfaces is exposed;

(f) a regenerator having an inlet connected to said discharge end of said outlet conduit and an outlet connected to said inlet end of said supply conduit for regenerating sorbent-laden sorption material received from said outlet conduit and for admitting sorbent-free sorption material into said supply conduit;

(g) a first conveyor arranged in said outlet conduit for advancing sorbent-laden sorption material from said pump housing into said regenerator; and (h) a second conveyor arranged in said supply conduit for advancing sorbent-free sorption material from said regenerator into said pump housing.

2. A cryosorption pump as defined in claim 1, wherein said pump housing has a downwardly tapering conical bottom including a downwardly-oriented apex; said inlet end of said outlet conduit being connected to said apex.

3. A cryosorption pump as defined in claim 1, further comprising a conical diverter situated below said discharge opening of said supply conduit and above said wall surfaces; said conical diverter tapering upwardly and having an apex situated closely underneath said discharge opening of said supply conduit; said conical diverter having a peripheral lower edge defining an annular clearance with an inner face portion of said pump housing; said diverter having a plurality of apertures generally conforming to the grain diameter of said granular sorption material for allowing passage thereof; the conicity of said diverter corresponding to that of an alluvial cone of said sorption material dwelling underneath said diverter.

4. A cryosorption pump as defined in claim 3, wherein said wall surfaces are vertically oriented and are situated side by side underneath said diverter; further wherein said pump housing has a bottom; upper and lower ends of said wall surfaces conforming to the course of said diverter and said bottom, respectively; the upper and lower ends of each said wall surface being spaced from said diverter and said bottom, respectively for permitting a ready downward flow of said sorption material in said pump housing.

5. A cryosorption pump as defined in claim 1, further comprising an inlet valve for opening and closing said inlet of said regenerator, an outlet valve for opening and closing said outlet of said rengenerator and an escape valve connected to said regenerator for releasing gases freed during desorption of the sorption material in said regenerator.

6. A cryosorption pump as defined in claim 5, further comprising control means connected to said inlet valve, said outlet valve, said escape valve, and said first and second conveyors for maintaining said inlet valve and said outlet valve closed, said escape valve open and said first and second conveyors de-energized during a first period sufficient for a desorption of a batch of sorbent-laden sorption material dwelling in said regenerator and for maintaining said inlet valve and said outlet valve open, said escape valve closed and said first and second conveyors energized during a second period for simultaneously removing a sorbent-free batch of sorption material from said regenerator into said supply conduit, for removing sorbent-laden sorption material from said pump housing into said outlet conduit, for introducing sorbent-laden sorption material from said outlet conduit into said regenerator and for introducing sorbent-free sorption material from said supply conduit into said pump housing.

7. A cryosorption pump as defined in claim 5, wherein said inlet, outlet and escape valves are solenoid valves.

8. A cryosorption pump as defined in claim 1, wherein said regenerator has heating means for accelerating desorption of the sorbent-laden sorption material in said regenerator.

9. A cryosorption pump as defined in claim 1, further comprising cooling means connected with said supply conduit for cooling the sorption material, prior to its introduction into the pump housing, to a cryogenic temperature which is higher than the cryogenic temperature of said wall surfaces.

10. A cryosorption pump as defined in claim 1, wherein said first and second conveyors are worm conveyors; further comprising electric motor means for driving said worm conveyors.

* * * * *